US006164381A

United States Patent [19]

Sundholm

[11] Patent Number: 6,164,381

[45] Date of Patent: Dec. 26, 2000

[54] DRIVE SOURCE FOR FEEDING EXTINGUISHING MEDIUM INTO SPRAY HEAD FOR EXTINGUISHING FIRE

[76] Inventor: Göran Sundholm, Ilmari Kiannon kuja 3, FIN-04310 Tuusula, Finland

[21] Appl. No.: 09/380,394

[22] PCT Filed: Feb. 1, 1999

[86] PCT No.: PCT/FI99/00068

§ 371 Date: Sep. 16, 1999

§ 102(e) Date: Sep. 16, 1999

[87] PCT Pub. No.: WO99/38573

PCT Pub. Date: Aug. 5, 1999

[30] Foreign Application Priority Data

| | | | |
|---|---|---|---|
| Feb. 2, 1998 | [FI] | Finland | 980232 |
| Mar. 27, 1998 | [FI] | Finland | 980705 |
| Apr. 2, 1998 | [FI] | Finland | 980772 |

[51] Int. Cl.[7] ..... A62C 35/00

[52] U.S. Cl. ..... 169/13; 169/15

[58] Field of Search ..... 169/5, 9, 14, 16, 169/44, 46, 51, 13, 15, 17; 417/46, 393, 395

[56] References Cited

U.S. PATENT DOCUMENTS

| | | | |
|---|---|---|---|
| 241,000 | 5/1881 | Granger | 169/46 |
| 3,790,310 | 2/1974 | Whelan | 417/388 |
| 3,949,812 | 4/1976 | Hay | 169/61 |
| 4,178,240 | 12/1979 | Pinkerton | 210/22 |
| 4,224,994 | 9/1980 | Tone et al. | 169/9 |
| 4,419,056 | 12/1983 | Ege | 417/426 |
| 4,527,634 | 7/1985 | Lee | 169/13 |
| 5,676,210 | 10/1997 | Sundholm | 169/9 |
| 5,713,417 | 2/1998 | Sundholm | 169/46 |
| 5,738,174 | 4/1998 | Sundholm | 169/46 |
| 5,799,735 | 9/1998 | Sundholm | 169/13 |
| 5,810,091 | 9/1998 | Sundholm | 169/46 |
| 5,845,714 | 12/1998 | Sundholm | 169/46 |
| 5,909,775 | 6/1999 | Grindley | 169/14 |
| 5,944,112 | 8/1999 | Sundholm | 169/9 |
| 6,006,840 | 12/1999 | Sundholm | 169/9 |

FOREIGN PATENT DOCUMENTS

| | | |
|---|---|---|
| 9222353 | 12/1992 | WIPO . |
| 9408659 | 4/1994 | WIPO . |

*Primary Examiner*—Andres Kashinkow
*Assistant Examiner*—Jorge Bocanegra
*Attorney, Agent, or Firm*—Ladas & Parry

[57] ABSTRACT

A drive source for feeding extinguishing medium into at least one spray head (2, 3) for extinguishing fire has a liquid source (5) and a gas source (9), apparatus for mixing the liquid and gas from their sources (5,9) and apparatus for transporting the mixed liquid and gas to the spray head (2, 3). In order for the drive source to control dosage of the gas into the liquid and, preferably, substantially even and small droplet size for a substantially long time during the extinguishing, the apparatus for mixing the liquid and gas has a piston-and-cylinder apparatus (50) including a first piston (12) in a first cylinder (10) and a second piston (13) in a second cylinder (11) for providing simultaneously at each stroke both liquid and gas to the apparatus or transporting the mixed liquid and gas.

16 Claims, 8 Drawing Sheets

DRIVE SOURCE FOR FEEDING EXTINGUISHING MEDIUM INTO SPRAY HEAD FOR EXTINGUISHING FIRE

BACKGROUND OF THE INVENTION

The present invention relates to fire fighting installations. More particularly the invention relates to a drive source or a drive unit for feeding extinguishing medium into at least one spray head. In greater detail the invention relates to a drive source for feeding extinguishing medium into at least one spray head for extinguishing fire, the drive source comprising a liquid source including liquid and a gas source including gas, mixing means for mixing the liquid of the liquid source and the gas of the gas source, and transportation means for leading the liquid and the gas into the spray head in such a manner that an extinguishing medium including a liquid component and a gas component is led to the spray head for releasing the extinguishing medium from the spray head in the form of a mixture of gas and liquid droplets.

It is known to use gas under pressure to drive out extinguishing liquid from a water container and to feed the extinguishing liquid further into spray heads or sprinklers, i.e. spray heads with release means. The release means is typically, but not necessarily, a glass ampoule reacting to heat by breaking and thus causing release.

It has not been possible to control the feeding of gas into liquid as accurately as desired with prior art means.

An extinguishing medium with very small droplets has been possible to obtain with certain types of spray heads or sprinklers. When the liquid is water, water mist is obtained. Water mist has proven to be effective and environmental friendly in fire extinguishing. Very small water droplets effectively absorb heat and have also an extinguishing effect. In addition the consumption of extinguishing liquid remains low. However, it has become a technical problem to provide such a device comprising pressure accumulators, said device being capable of emitting water mist including sufficiently small water droplets during a longer period. This occurs because the droplet size increases when the pressure accumulators are emptied, i.e. when pressure is reduced, at the end of the extinguishing process. The problem has partly been solved by mixing gas at the end of the extinguishing process, as presented in the International Patent Application with the publication number WO 94/08659. The gas can be the same gas that is used as propellant to initially drive out the extinguishing liquid and later to drive out the liquid component of the extinguishing medium containing gas. Owing to the gas mixture it has been possible to obtain extremely small water droplets.

Even if good results have been obtained by the last mentioned apparatuses, there has been a need to produce a drive source which is in a controlled manner able to mix gas in the extinguishing liquid, and in such a manner that the drop size remains relatively constant also for a long time and during discharge of a very large amount of extinguishing medium. There has also been a need to make the fire fighting installations as simple as possible including a wish to keep the number and volume of available gas and water containers as small as possible.

BRIEF DESCRIPTION OF THE INVENTION

An object of the invention is to remove said problems and draw-backs. For this purpose the invention is characterized in that the mixing means comprise a cylinder piston apparatus comprising a first piston arranged within a first cylinder and a second piston arranged within a second cylinder, both cylinders comprising a first chamber and a second chamber, the gas source is alternatively connected to the second chamber of the first cylinder or to the second chamber of the second cylinder through a conduit system, whereto a directional valve is connected, the directional valve is by means of a control device arranged in a first operating position to keep a connection between the gas source and the second chamber of the first cylinder open and a connection between the second chamber of the second cylinder and an outlet conduit of the transportation means open and in a second operating position to keep a connection between the gas source and the second chamber of the second cylinder open and a connection between the second chamber of the first cylinder and the outlet conduit open.

A great advantage with the drive source of the invention is that it enables dosage and controlled mixture of gas into the extinguishing liquid and that an even and, if desired, very small droplet size is obtained for a long time during an extinguishing process. Another advantage is that the capacity of the drive source is automatically adapted to the number of spray heads and the resistance (loss of pressure) therein: the operating speed of the cylinder piston apparatus (strokes per unit of time) depends on the number of nozzles and the resistance therein. If the number of nozzles is large and the resistance is low, the cylinder piston apparatus operates rapidly, if the number of nozzles is small and the resistance is high, the cylinder piston apparatus operates slowly. On this account a fire extinguishing system can be designed without any particular calculations and the same drive source is in principle suitable for both large and small fire extinguishing systems. A further advantage is that such an ordinary low pressure liquid source (for example about 4–10 bar), like a water mains, is adequate, or even a no pressure liquid source, since the cylinder piston apparatus of the drive source is self-sucking (self-priming). A water mains is able to discharge, if necessary, large amounts of extinguishing liquid. The need of water containers is thus removed. Another advantage is the very safe function of the drive source and the possibility of making its function independent of electricity.

BRIEF DESCRIPTION OF THE DRAWINGS

In the following the invention will be described in more detail by means of three embodiments with reference to the accompanying drawing, in which.

DETAILED DESCRIPTION OF THE INVENTION

Figure 1:
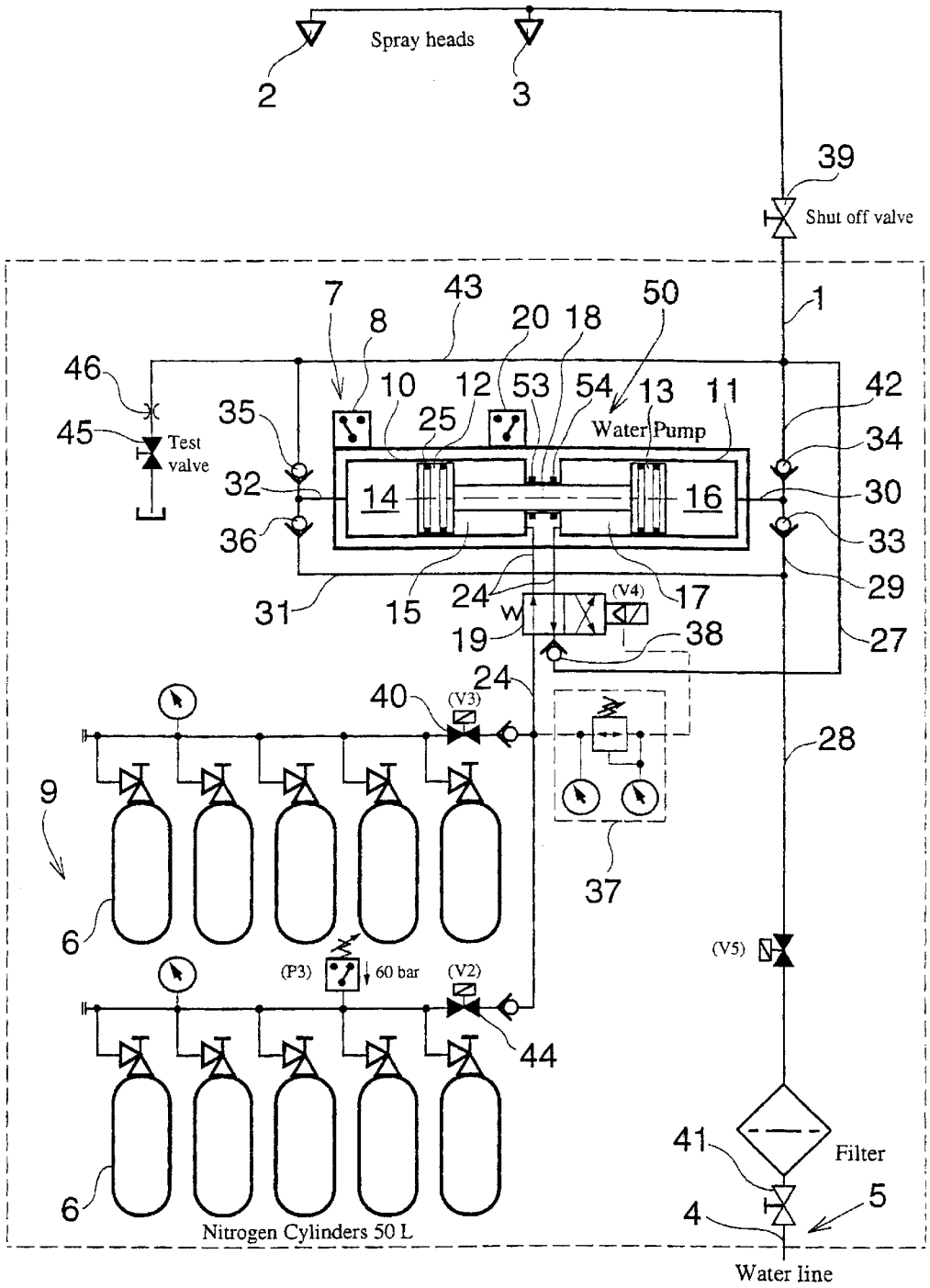
FIG. 1 shows a first embodiment of the invention.

FIG. 1 shows a drive source or a drive unit for feeding extinguishing medium through an outlet conduit 1 to a spray head 2, 3. The extinguishing medium is a mixture of liquid and gas. Water or a water-based liquid is used as liquid, and as gas, preferably incombustible gas, for example nitrogen. It should be noted that gases, which are not referred to as incombustible gases, for example air, can be used as gas. The liquid is obtained from a water mains 5 through a water conduit 4. Consequently, the water mains 5 provides a liquid source for the drive source. The gas is obtained from a gas source 9 consisting of ten gas containers 6, which are arranged in two sets of five gas containers each, the sets being connected in parallel. The gas containers 6 contain nitrogen, have a volume of 50 I and a pressure of 200 bar. The gas pressure can preferably be within the range of 50–300 bar. The structure of the gas source can naturally vary, which is why the number of gas containers 6 and the volume thereof may vary. The number of sets of gas containers may also vary, but it is also possible to use only one set.

In order to mix the gas of the gas container 6 into water the drive source comprises a cylinder piston apparatus 50 comprising two separate cylinders 10 and 11, placed in line, each including a piston 12 and 13, respectively. The cylinders 10, 11 each include two chambers 14, 15 and 16, 17, respectively. The pistons 12, 13 are connected together using a piston rod 18 and move synchronously in such a manner that when the piston 13 moves to the right the piston 12 also moves to the right, the pistons thus moving in opposite directions in respective cylinders. Instead of a piston rod another type of connecting part can be used for connecting the movements of the pistons 12, 13. The reference numerals 53, 54 indicate seals.

The gas source 9 is through a conduit system 24 including a directional valve 19 optionally connected to the chamber 15 and the chamber 17.

The position of the directional valve 19 is determined by a signal that is provided by a control device 7 comprising two detector-signal devices 8, 20 that react to magnetic changes. The piston 12 comprises a magnetic band 25 or another part with magnetic properties. The detector-signal devices 8, 20 react to the presence of the magnetic band so as to give a signal to the directional valve 19 for every new piston stroke in the same direction. The signal may be electric (electric lines are not shown in the, Figure between the control device and the directional valve).

By means of the control device 7 and the directional valve 19 the gas source 9 is in turn connected over to the chamber 15 and to the chamber 17 every time the pistons 12, 13 change direction.

The directional valve 19 operate so that it connects the chamber 15 to the outlet conduit 1 through a conduit 27 when the connection between the chamber 15 and the gas source 9 is broken and the connection between the chamber 17 and the gas source is open. When the connection between the chamber 15 and the gas source 9 is open, the connection between the chamber 17 and the outlet conduit 1 through the conduit 27 is also open.

Reference numeral 37 indicates a pressure reducing valve that reduces the pressure from the gas source to about 6 bar, the relatively low pressure providing the work that is needed to connect the directional valve 19 to the different operating positions described.

Figure 8:
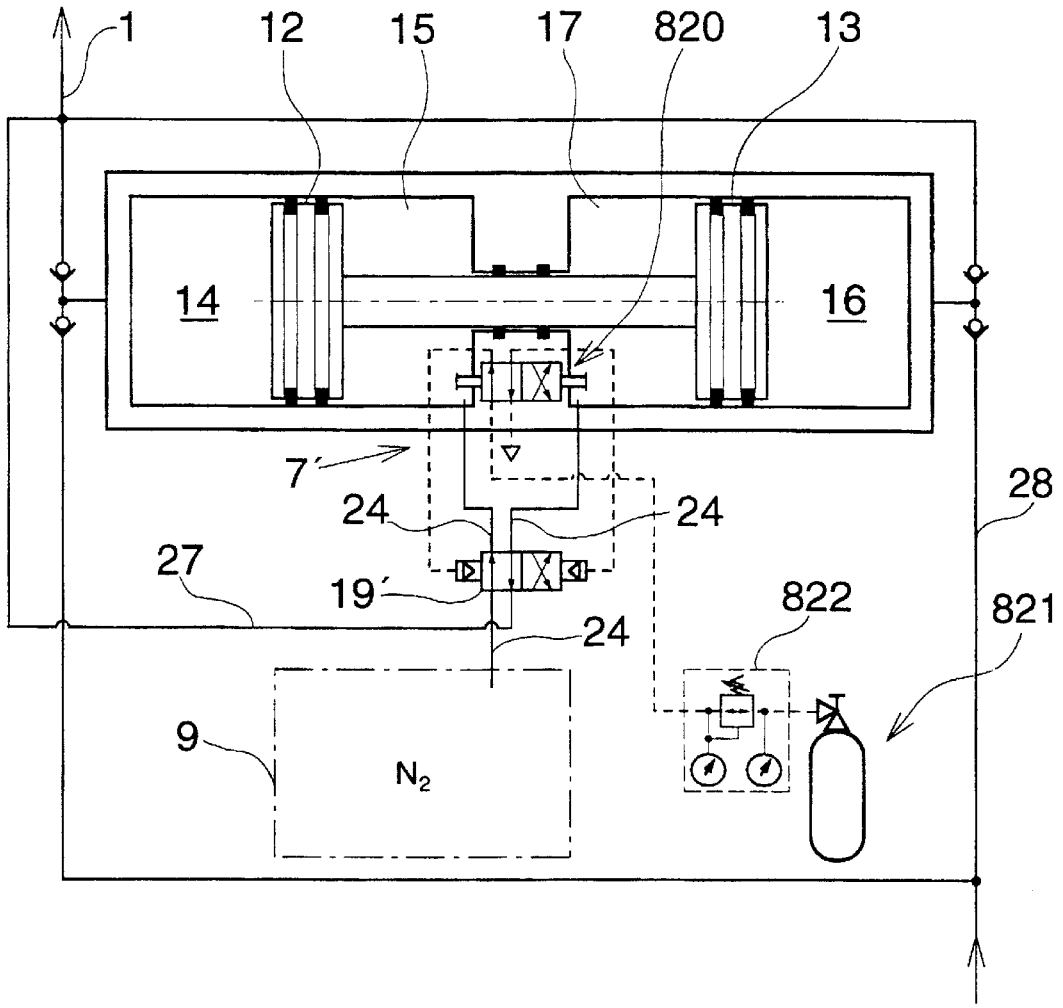
FIG. 8 illustrates an alternative manner of controlling the drive source in FIGS. 1 to 7.

FIG. 8 shows a control device 7' as an alternative to the control device 7. The control device controls a pneumatically controlled directional valve 19', by virtue of a valve device positioned between and protruding into the chambers 15, 17. A pneumatic pressure source 821 is connected to the valve device 820. The pressure source 821 may be replaced by one of the gas containers 6 of the gas source 9. The valve device 820 controls, by virtue of pressure and through the pressure source 821, the positions of the directional valve 19' in the same way as the detector-signal devices 8, 20 do; and the directional valve 19' controls the movements of the pistons 12, 13 in the same way as the directional valve 19 does. When the piston 12 moves to the leftmost position, the piston 13 mechanically presses against the valve device 820, whereby the valve device settles into a first position, and when the piston 12 moves to the right and the piston 13 moves to the rightmost position, the piston mechanically presses against the valve device 820, whereby the valve device settles into a second position. The pressure source 821 provides the force that is required in order to position the directional valve 19' into the described operating positions. The force needed to position the valve device 820 into the different positions is minimal compared with the force needed to position the directional valve 19' into the different operating positions.

The advantage with the control device 7', compared to the control device 7, is that it is capable of functioning without electricity (owing to a pneumatic functioning mechanism). The drive source is capable of functioning without electricity; this is an essential advantage in a fire fighting installation in case of fire.

Reference numerals 28–30 indicate conduits for feeding water into the chamber 16 and reference numerals 28, 31, 32 indicate conduits for feeding water into the chamber 14. Reference numerals 42 and 43 and also 30 and 32 indicate conduits for conveying water to the outlet conduit 1. Reference numerals 33, 34, 35, 36, 38 indicate check valves. The function of the check valves is to hinder the medium (water or gas) to flow in an undesirable direction.

Numeral 39 represents a valve that shuts off the entire function of the system and that is connected to the outlet conduit 1. Numeral 40 and 44, respectively, represent valves that connect and disconnect the upper and lower sets of gas containers.

Reference numeral 45 indicates a test valve that is connected through a throttling 46 to the conduit 43 conveying water to the outlet conduit 1. The test valve 45 can ascertain the presence of liquid under pressure.

In the following the function of the drive force will be described.

The drive source is started after a fire has been detected. Initially there is water in the chambers 14 and 16 and the pistons of the piston cylinder apparatus are in the position shown in FIG. 1. The valves 39–41 are open. On account of gas flowing into the chamber 15 at high pressure the pistons 12, 13 are conveyed to the left. Hereby, the water is pressed out of the chamber 14 into the conduits 32, 43 and further to the outlet conduit 1. At the same time as the pistons move to the left air is pumped from chamber 17 through the conduit 27 to the outlet conduit 1 and the chamber 16 is filled with water. When the magnetic band 25 in the piston 12 comes close enough to the detector-signal device 8, this provides a signal to the directional valve 19 that connects over so that gas under high pressure can flow from the gas source 9 into the chamber 17 and the high pressure gas in the chamber 15 can flow through the conduit 27 to the outlet conduit 1. The pistons then move to the right and the water in the chamber 16 flows out through the conduits 30 and 42 to the outlet conduit 1, and water simultaneously flows through the conduits 31 and 32 into the chamber 14. When the magnetic band 25 in the piston 12 comes close enough to the detector-signal device 20, this provides a signal to the directional valve 19 that connects over so that the gas can flow again into the chamber 15, whereby the above procedure is repeated, except that from now on nitrogen gas is pumped instead of air through the conduit 27 to the outlet conduit.

Hence, each time the pistons move to the left or the right both water and nitrogen gas is simultaneously pumped into the outlet conduit 1. pistons may have a velocity of, for example, one stroke per second. The drive source functions as a booster.

On account of the above function the outlet conduit 1 is filled with a mixture of gas and water forming a very good extinguishing medium discharged from the spay heads 2, 3.

The drive source described allows to dose gas in the extinguishing liquid in controlled amounts and also to obtain from the spray heads during a long period, like an hour, an extinguishing medium including extremely small droplets, the size thereof varying only slightly. It is possible to vary the volume in the chambers 15 and 17 by changing, for example, the diameter of the piston rod 18 in relation to the volume in the chambers 14 and 16. Thus, amounts of gas mixed in the liquid can be obtained providing various gas-liquid ratios.

Figure 2:
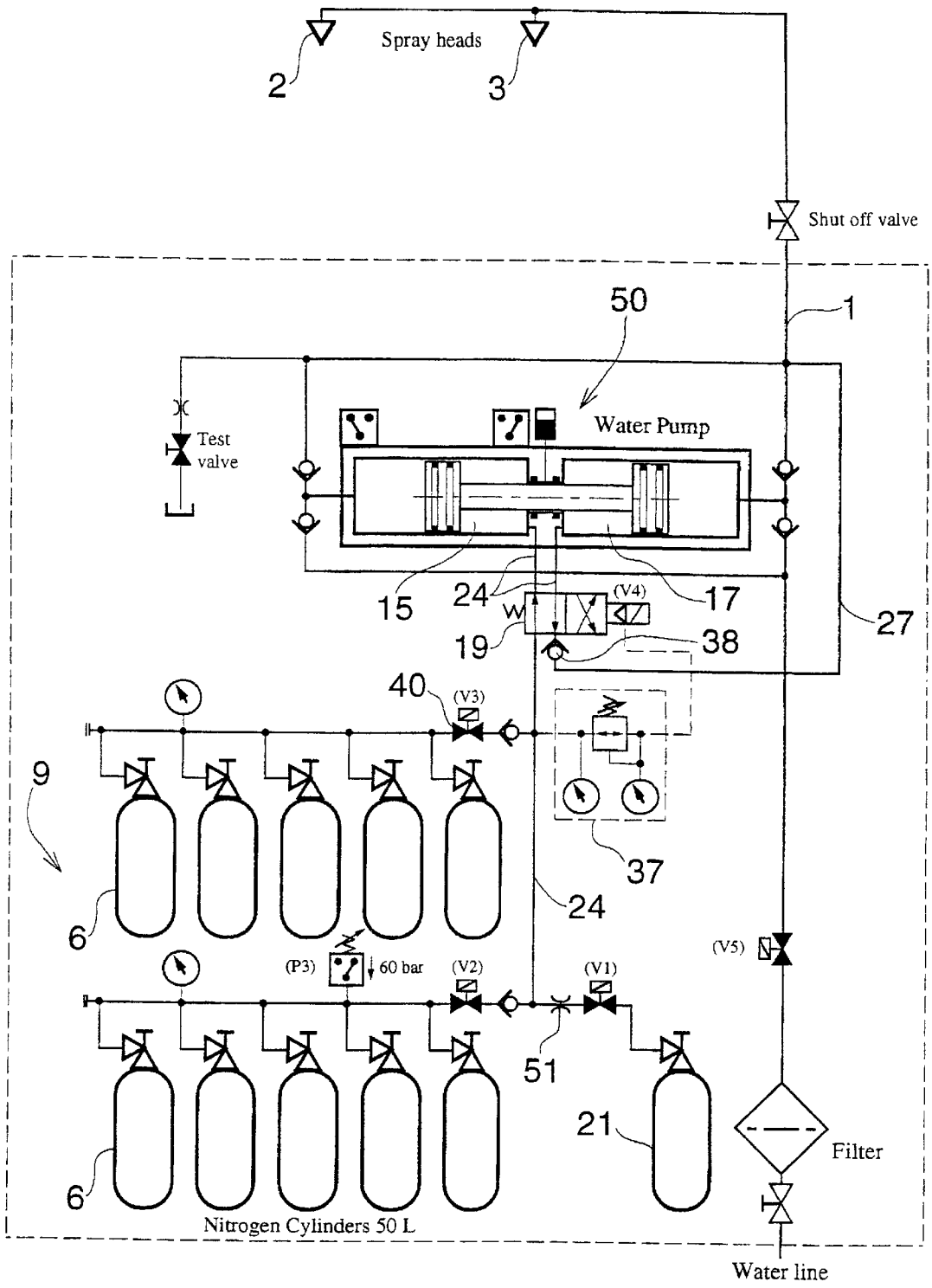
FIG. 2 shows a second embodiment of the invention.

FIG. 2 shows another variant of the invention in FIG. 1. The same reference numerals are used in FIG. 2 as in FIG. 1 for corresponding components. The drive source in FIG. 2 differs from the one in FIG. 1 by connecting a gas bottle 21 preferably at a high pressure of 200 bar to the conduit system 24. The gas bottle 21 is connected between the gas source 9 and the directional valve 19 for the drive source to initially, before the gas containers 6 are switched on, feed water at relatively low pressure, 5–25 bar, for example 16 bar, in the outlet conduit 1 and the spray heads 2, 3 in order to cool these. The relatively low pressure is obtained by the gas bottle 21 being connected to the conduit system 24 through a throttling 51 or a pressure reducing valve. Owing to the high pressure of the gas bottle 21 the volume thereof can be low. The gas bottle 21 is depending on the position of the directional valve 19 alternatively connected to the second chamber 15 of the first cylinder or the second chamber 17 of the second cylinder, respectively.

Figure 3:
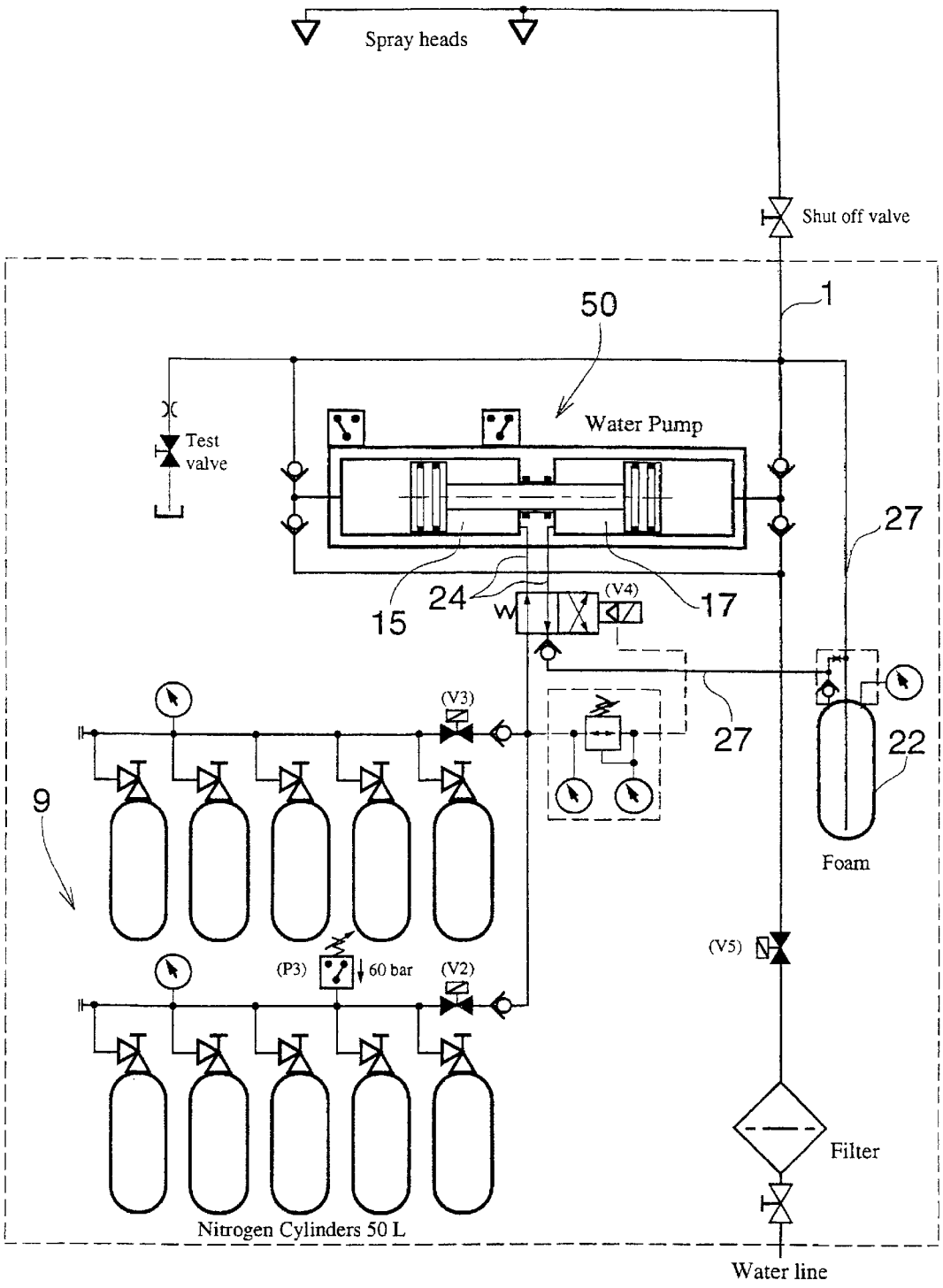
FIG. 3 shows a third embodiment of the invention.

FIG. 3 shows a third variant of the invention in FIG. 1. The same reference numerals are used in FIG. 3 as in FIG. 1 for corresponding components. The drive source in FIG. 3 differs from the one in FIG. 1 in that a container 22 including foam is connected to the gas conduit 27 in order to obtain gas pressure alternatively from the second chamber 15 of the first cylinder or the second chamber 17 of the second cylinder, the container 22 being connected to the outlet conduit 1 in order to feed foam into the extinguishing medium in the outlet conduit. The gas pressure from the chambers 15, 17 function as a driving force for pressing the foam out of the container 22. As the container 22 is emptied it functions as a shock absorber to absorb pressure peaks that arise in the outlet conduit 1 when the chambers 15, 17 are emptied of gas when discharging gas to the outlet conduit 1. On account of the container 22 the pressure load in the drive source conduits 24, 27, 1 is reduced and these need not be dimensioned for high pressure loads.

Figure 4:
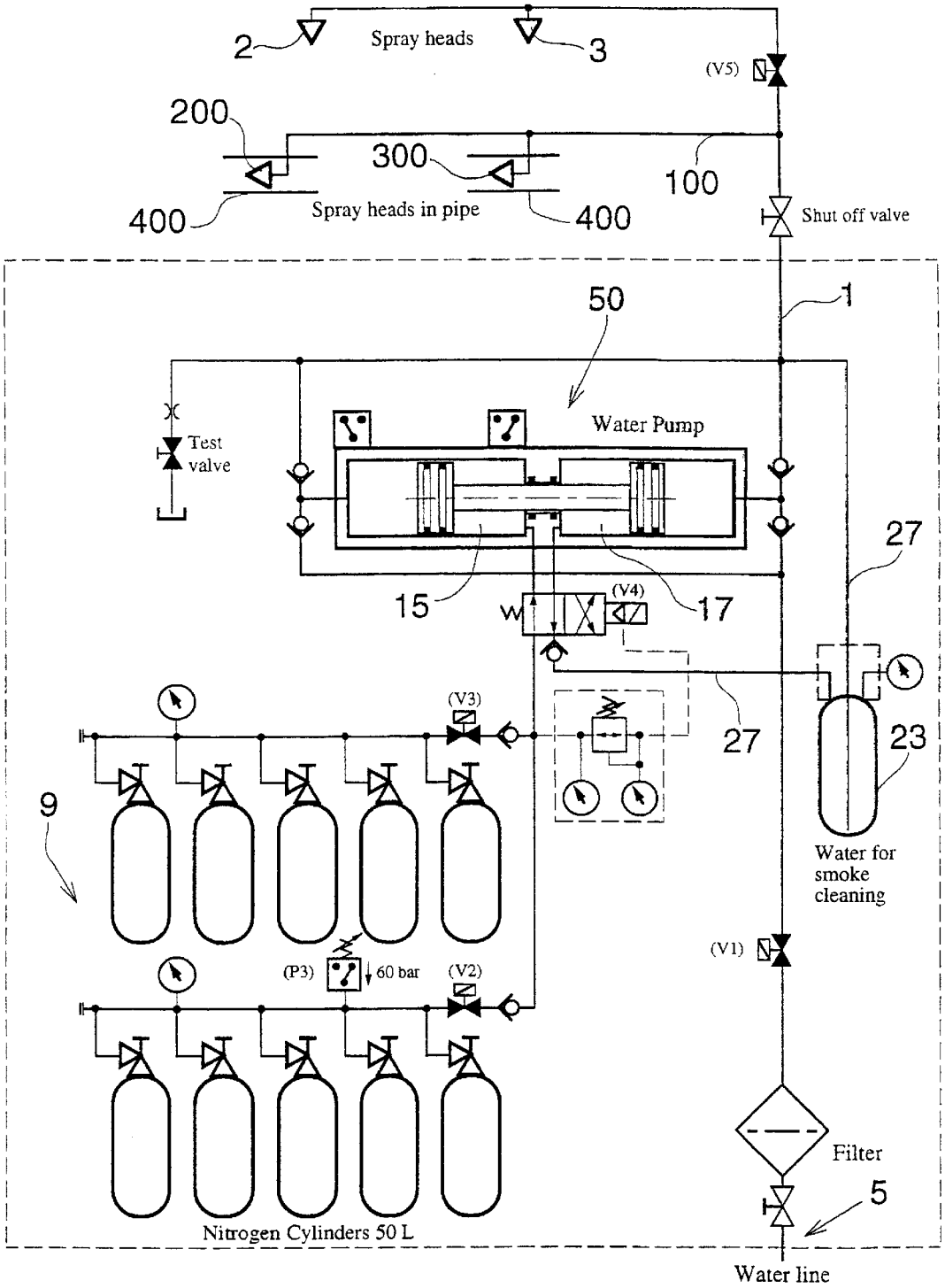
FIG. 4 shows a fourth embodiment of the invention.

FIG. 4 shows a fourth variant of the invention in FIG. 1. The same reference numerals are used in FIG. 4 as in FIG. 1 for corresponding components. The drive force in FIG. 4 differs from the one in FIG. 1 in that a water container 23 is connected to the gas conduit 27 in order to obtain gas pressure alternatively from the second chamber 15 of the first cylinder or the second chamber 17 of the second cylinder, the water container 23 being connected to the outlet conduit 1, for initially feeding only water into the outlet conduit. The gas pressure from the chambers 15, 17 function as a driving force for pressing out the water from the water container 23. The drive source is arranged to initially feed the water through a pipe line 100 to spray heads 200, 300 which are constructed to provide water mist and to accomplish a suction attracting smoke gases. The water mist is used to wash smoke gases. These spray heads 200, 300 may be arranged in a pipe 400 like the one described in PCT/FI 97/00523. After water has been emptied from the water container 23 the driving apparatus functions as the one described in FIG. 1, however, with the difference that the water container 23 is able to reduce pressure peaks that arise in the outlet conduit I when the chambers 15, 17 are emptied of gas when discharging gas to the outlet conduit 1. On account of the container 23 the pressure load in the drive source conduits 24, 27, 1 is reduced and these need not be dimensioned for high pressure loads.

Figure 5:
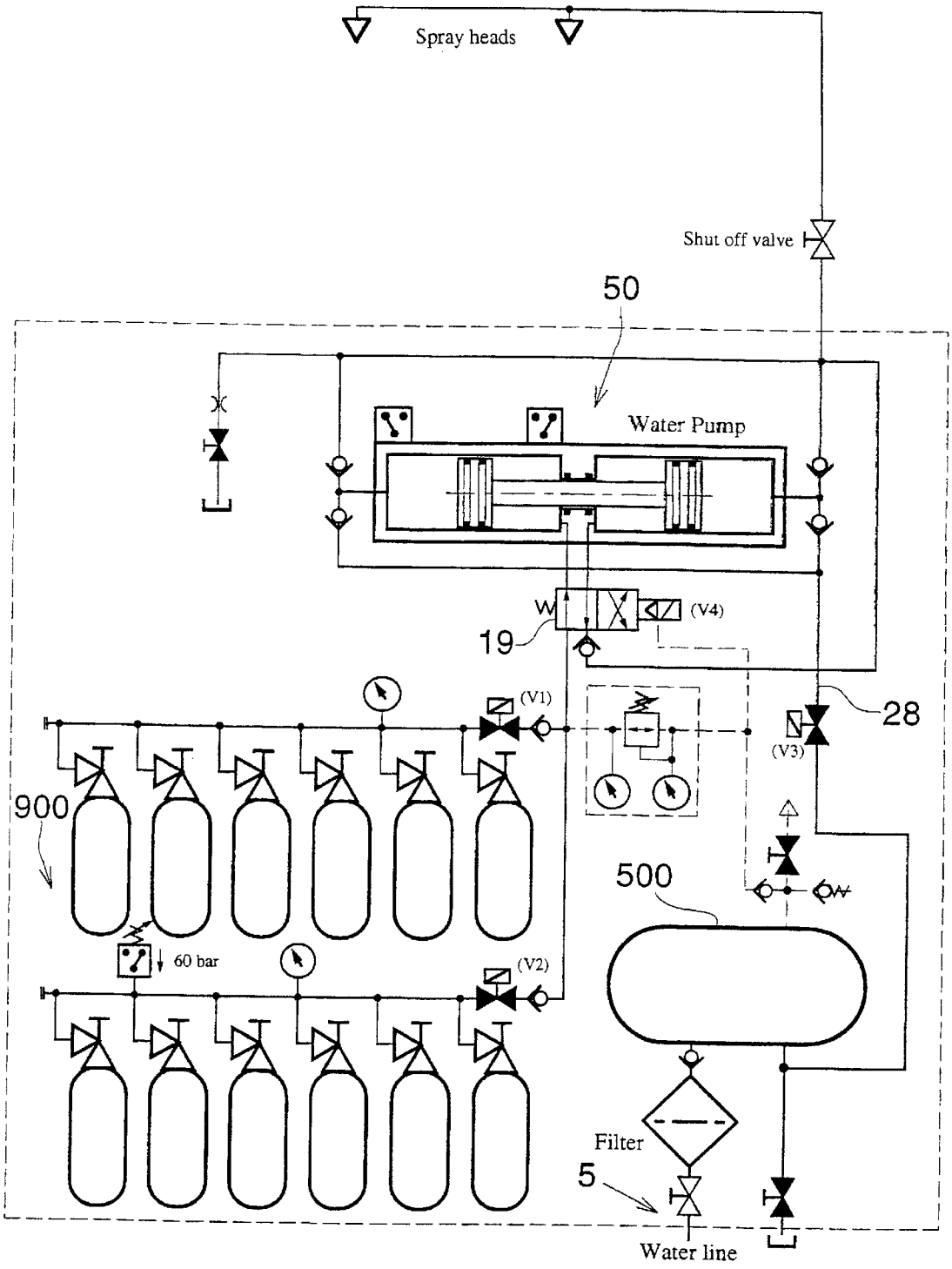
FIG. 5 shows a fifth embodiment of the invention.

FIG. 5 shows a fourth variant of the invention in FIG. 1. The same reference numerals are used in FIG. 5 as in FIG. 1 for corresponding components. The drive force in FIG. 5 differs from the one in FIG. 1 by connecting a water container 500 to feed water into the conduit 28. The water container 500 is pressurized after opening the valve V1 or V2, for example, on the basis of a signal from a smoke detector (not shown) or another detector, and thereafter pressure flows from the gas containers 6 to the water container 500. The pressure in the water container 500 can initially be, for example 4 bar, and typically within the range of 2-12 bar. The water container 500 obtains the pressure through the pressure reducing valve 37 which reduces the incoming pressure from the gas containers 6. After the water container 500 ha been emptied the water mains 5 can be switched on in order to discharge more water to the conduit 28 and the piston cylinder apparatus 50.

Figure 6:
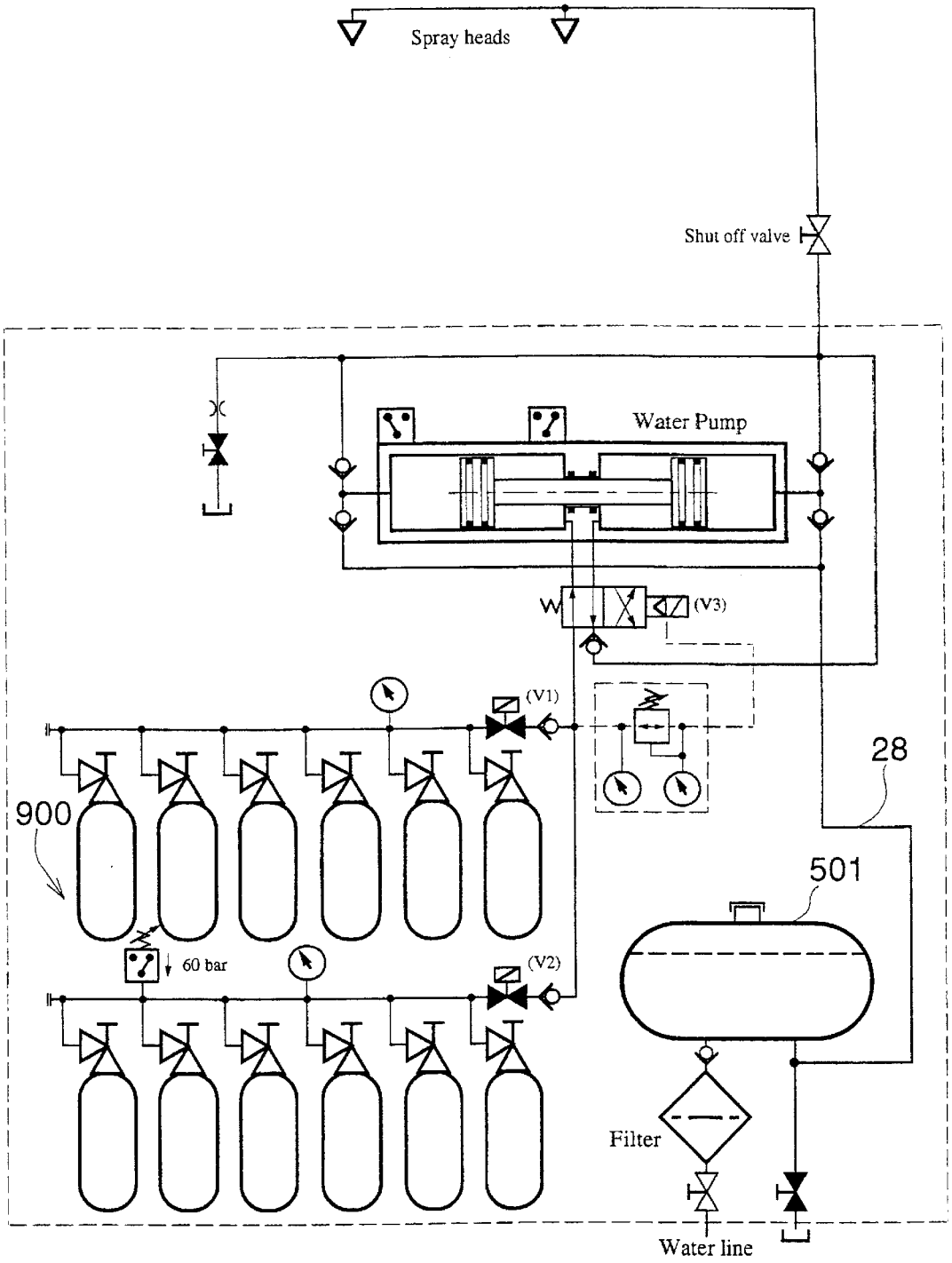
FIG. 6 shows a sixth embodiment of the invention.

FIG. 6 shows a variant of the drive source in FIG. 1. The drive source shown in FIG. 6 corresponds to the drive source shown in FIG. 1 with the exception of an unpressurized water container 501 for feeding water into the conduit 28. The cylinder piston apparatus is able to suck water from the water container 501, since the pistons 12, 13 suck water into the chambers 14, 16 by means of negative pressure. The water mains 5 is not needed at all if the volume and water content of the water container 501 are adequate.

Figure 7:
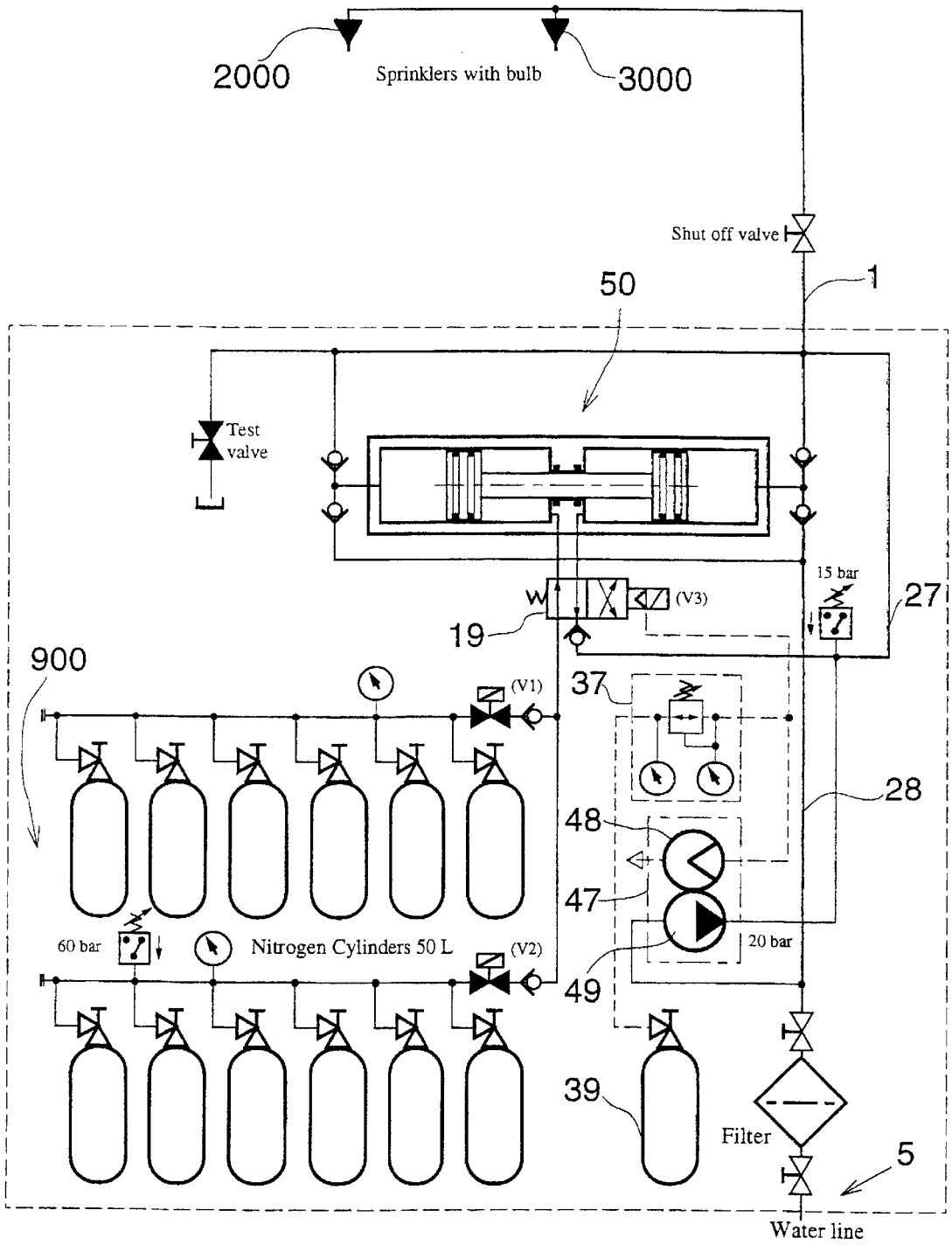
FIG. 7 shows a seventh embodiment of the invention.

FIG. 7 shows a variant of the drive source in FIG. 1. The drive source shown in FIG. 7 corresponds to the drive source in FIG. 1 except that it is arranged to keep a standby pressure in the outlet conduit 1 and sprinklers 2000, 3000. This is achieved by a pump unit 47 including a motor 48 and a pump 49 connected to the conduit 27. The pump unit 47 obtains its driving force from a pressurized gas container 39. The pump unit 47 increases pressure from the water mains 5 from 4 bar to e.g. 20 bar, thus keeping the outlet conduit 1 at a standby pressure of 20 bar. The sprinklers 2000, 3000 comprise spray heads connected to the outlet conduit 1, i.e. spray heads with release means like ampoules. The structure of the sprinklers 2000, 3000 allows a load with said standby pressure. The sprinklers 2000, 3000 can preferably be constructed as described in WO 92/15370 and WO 94/16771. The gas container 39 is connected to the directional valve 19 through the pressure reducing valve 37 in order to provide the directional valve 19 with power from the gas container 39. After the release of the sprinklers 2000, 3000 due to heat or smoke, a detector observes a certain pressure loss, which is large enough, in the conduit 27 or a flow or pressure loss in the outlet conduit 1 or in the conduit 27, the pressure losses or the flow causing the detector to give a signal to the valve V1 or V2 to open, whereupon the drive source operates as the drive source in FIG. 1.

The invention is described above by means of examples only, and therefore, it is pointed out that the details of the invention may vary in many ways within the scope of the attached claims. Thus, the pistons 12, 13 need not be placed in cylinders 10 and 11, respectively, placed in line, although this is to be preferred since such an implementation is extremely easy and simple to technically execute. The structure of the control device 7 may vary. The driving force for the directional valve 19 can be accomplished in various ways. The drive source can be used to discharge a liquid-like spray including relatively large droplets from the spray heads. The gas source does not need to be composed of pressurized gas containers 6; for example, a pressure air network (not shown) can preferably be applied instead. Such a pressure air network does not require high pressure but may have a low pressure of 6–10 bar.

What is claimed is:

1. Drive source for feeding extinguishing medium into at least one spray head (2, 3; 2, 3; 200, 300; 2000, 3000) for extinguishing fire, the drive source comprising a liquid source (5; 500; 501) including liquid and a gas source (9; 900) including gas, mixing means for mixing the liquid of the liquid source (5; 500; 501) and the gas of the gas source (9, 900), and transportation means for leading the liquid and the gas into the spray head in such a manner that an extinguishing medium including a liquid component and a gas component is led to the spray head for releasing the extinguishing medium from the spray head in the form of a mixture of gas and liquid droplets, characterized in that the mixing means comprise a cylinder piston apparatus (50) comprising a first piston (12) arranged within a first cylinder (10) and a second piston (13) arranged within a second cylinder (11), both cylinders comprising a first chamber (14 and 16, respectively) and a second chamber (15 and 17, respectively), the gas source (9; 900) is alternatively connected to the second chamber (15) of the first cylinder or the second chamber (17) of the second cylinder through a conduit system (24) whereto a directional valve (19, 19') is connected, the directional valve (19, 19') is by means of a control device (7, 7') arranged in a first operating position to keep a connection between the gas source (9; 900) and the second chamber (15) of the first cylinder open and a connection between the second chamber (17) of the second cylinder and an outlet conduit (1; 1, 100) of the transportation means open and in a second operating position to keep a connection between the gas source (9; 900) and the second chamber (17) of the second cylinder open and a connection between the second chamber (15) of the first cylinder and the outlet conduit (1; 1,100) open.

2. A drive source as claimed in claim 1, characterized in that the pistons (12, 13) are interconnected by means of a connecting part (18).

3. A drive source as claimed in claim 2, characterized in that the connecting part (18) is at least substantially a straight piston rod (18) and the cylinders (10, 11) are arranged at least substantially in line with each other, whereby the pistons (12, 13) are arranged to move synchronously in the opposite direction in their respective cylinders.

4. A drive source as claimed in claim 1, characterized in that the control device (7) comprises a detector-signal device (8, 20) reacting to magnetic changes, and the piston (12) of the first cylinder (10) comprises a part (25) of magnetic material, whereby the detector-signal device is connected to said cylinder (10) in order to react to the movement of the piston (12) in said cylinder (10) to give a signal to the directional valve (19) for each new piston stroke in the same direction.

5. A drive source as claimed in claim 1, characterized in that a pressure reducing valve (37) is connected between the gas source (9; 900) and the directional valve (19) in order to provide the directional valve with driving force from the gas source.

6. A drive source as claimed in claim 1, characterized in that the control device (7') comprises a valve device (820) adapted to move from a first position to a second position mechanically controlled by the pistons (12, 13) in such a way that the valve device moves from one of said pistons to the other of said positions always when the pistons change direction of movement, said valve device being adapted to control a pressure source (821) by virtue of pressure in such a way that the pressure source moves the directional valve (19') into the first operating position when the valve device is in the first position and moves the directional valve into the second position when the valve device is in the second position.

7. A drive source as claimed in claim 1, characterized by a first conduit (31) including a check valve (36), for feeding liquid from the liquid source (5; 5, 500; 501) to the first chamber (14) of the first cylinder (10) and by a second conduit (29) including a check valve (33), for feeding liquid from the liquid source to the first chamber (16) of the second cylinder (11) and by a third conduit (43) including a check valve (35), for feeding liquid from the first chamber (14) of the first cylinder to the outlet conduit (1; 1, 100) and by a fourth conduit (42) including a check valve (34), for feeding liquid from the first chamber (16) of the second cylinder to the outlet conduit (1; 1, 100), and by a first gas conduit (27) including a check valve (38) for providing a connection from the directional valve (19) to the outlet conduit (1; 1, 100).

8. A drive source as claimed in claim 1, characterized in that a gas bottle (21) is connected to the conduit system (24), the gas bottle being arranged between the gas source (9) and the directional valve (19) in order to communicate alternatively with the second chamber (15) of the first cylinder or the second chamber (17) of the second cylinder, respectively, for cooling the outlet conduit (1) and the spray heads (2, 3) with extinguishing medium under pressure, the pressure being lower than the pressure of the gas source (9).

9. A drive source as claimed in claim 1, characterized in that a container (22) including foam is connected to the first gas conduit (27) in order to obtain gas pressure from the second chamber (15) of the first cylinder or the second chamber (17) of the second cylinder, respectively, and the container (22) being connected to the outlet conduit (1) for feeding foam into the extinguishing medium in the outlet conduit.

10. A drive source as claimed in claim 7, characterized in that a water container (23) is connected to the first gas conduit (27) in order to obtain gas pressure from the second chamber (15) of the first cylinder or the second chamber (17) of the second cylinder, respectively, and the water container (23) being connected to the outlet conduit (1, 100) for initially feeding only water into the outlet conduit.

11. A drive source as claimed in claim 1, characterized in that the liquid source comprises a liquid container (500)

connected to the gas source (900) through a pressure reducing device (3) in order to obtain a pressure in the liquid container that is lower than the pressure of the gas source.

12. A drive source as claimed in claim 1, characterized in that the liquid source comprises a non-pressurized liquid container (501).

13. A drive source as claimed in claim 1, where the spray head is a spray head of a sprinkler (2000, 3000), characterized in that a pump unit (47) comprising a motor (48) and a pump (49) is connected to the liquid source (5) and the outlet conduit (1) for keeping the outlet conduit under a standby pressure that is higher than the pressure of the liquid source, to which motor (48) a pressurized gas container (39) is connected to provide the motor and the pump with driving force.

14. A drive source as claimed in claim 13, characterized in that the gas container (39) is connected to the outlet conduit (1) through a pressure reducing valve (37) which is connected to the directional valve (19) in order to provide the directional valve with driving force from the gas container.

15. A drive source as claimed in claim 2, characterized in that the connecting part (18) is at least substantially a straight piston rod (18) and the cylinders (10, 11) are arranged at least substantially in line with each other.

16. Drive source for feeding extinguishing medium into at least one spray head (2, 3; 2, 3; 200, 300; 2000, 3000) for extinguishing fire, the drive source comprising:

a liquid source (5; 500; 501) including liquid and a gas source (9; 900) including gas, mixing means for mixing the liquid of the liquid source (5; 500; 501) and the gas of the gas source (9, 900), and transportation means for leading the liquid and the gas into the spray head in such a manner that an extinguishing medium including a liquid component and a gas component is led to the spray head for releasing the extinguishing medium from the spray head in the form of a mixture of gas and liquid droplets, characterized in that the mixing means comprise a cylinder piston apparatus (50) comprising a first piston (12) arranged within a first cylinder (10) and a second piston (13) arranged within a second cylinder (11), both cylinders comprising a first chamber (14 and 16, respectively) and a second chamber (15 and 17, respectively), the gas source (9; 900) is alternatively connected to the second chamber (15) of the first cylinder or the second chamber (17) of the second cylinder through a conduit system (24) whereto a directional valve (19, 19') is connected, the directional valve (19, 19') is by means of a control device (7, 7') arranged in a first operating position to keep a connection between the gas source (9; 900) and the second chamber (15) of the first cylinder open and a connection between the second chamber (17) of the second cylinder and an outlet conduit (1;1, 100) of the transportation means open and in a second operating position to keep a connection between the gas source (9; 900) and the second chamber (17) of the second cylinder open and a connection between the second chamber (15) of the first cylinder and the outlet conduit (1; 1, 100) open.

the outlet conduit (1; 1, 100) is alternatively connected to the second chamber (15) of the first cylinder or the second chamber (17) of the second cylinder through a conduit (27) for transporting gas from the cylinder piston apparatus (50) to the outlet conduit (1; 1, 100), and the directional valve (19, 19') is by means of the control device (7, 7') arranged in the first operating position to keep a connection between the outlet conduit (1; 1, 100) and the second chamber (17) of the second cylinder open and in the second operation position of keep a connection between the outlet conduit (1; 1, 100) and the second chamber (15) of the first cylinder open.

* * * * *